US007814704B2

(12) United States Patent
Suzuki et al.

(10) Patent No.: US 7,814,704 B2
(45) Date of Patent: Oct. 19, 2010

(54) METHOD FOR CONTROLLING DOOR AND DOOR CONTROL SYSTEM FOR VEHICLE

(75) Inventors: Shintaro Suzuki, Kasugai (JP); Eiji Itami, Chiryu (JP); Masahiko Ito, Toyota (JP); Masayuki Nomura, Aichi-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 334 days.

(21) Appl. No.: 11/598,092

(22) Filed: Nov. 13, 2006

(65) Prior Publication Data

US 2007/0107313 A1 May 17, 2007

(30) Foreign Application Priority Data

Nov. 15, 2005 (JP) ..... 2005-330639

(51) Int. Cl.
*E05F 11/53* (2006.01)

(52) U.S. Cl. ..... 49/26; 49/360; 49/28; 318/266; 318/280; 318/466; 296/155

(58) Field of Classification Search ..... 49/26, 49/27, 28, 163, 306, 360; 296/155, 146.4, 296/146.2; 318/256, 280, 286, 266, 283, 318/466

See application file for complete search history.

(56) References Cited

U.S. PATENT DOCUMENTS 5,436,539 A * 7/1995 Wrenbeck et al. ..... 318/265
5,689,160 A * 11/1997 Shigematsu et al. ..... 318/281
6,178,699 B1 * 1/2001 Kawanobe et al. ..... 49/360
6,580,243 B2 * 6/2003 Itami et al. ..... 318/452
6,659,539 B2 * 12/2003 Yogo et al. ..... 296/155
6,814,394 B2 * 11/2004 Yogo et al. ..... 296/155
7,100,325 B2 * 9/2006 Ichinose ..... 49/168
7,134,241 B2 * 11/2006 Suzuki ..... 49/28
7,210,731 B2 * 5/2007 Ichinose et al. ..... 296/155
2002/0153744 A1 * 10/2002 Long et al. ..... 296/155
2004/0070231 A1 * 4/2004 Yogo et al. ..... 296/155
2004/0119433 A1 * 6/2004 Tanoi et al. ..... 318/469
2004/0194385 A1 * 10/2004 Ichinose ..... 49/26
2004/0256883 A1 * 12/2004 Ichinose et al. ..... 296/155

(Continued)

FOREIGN PATENT DOCUMENTS

JP 2000-240352 A 5/2000

*Primary Examiner*—Katherine W Mitchell
*Assistant Examiner*—Daniel Cahn
(74) *Attorney, Agent, or Firm*—Buchanan Ingersoll & Rooney PC

(57) ABSTRACT

A method for controlling a power slide door having an operable window for a vehicle for preventing an entrapment between the power slide door and a vehicle body by limiting a slidable range of the power slide door by portion of a stopper, which the stopper functions in a condition where the window is opened more than or equal to a certain range, the method comprising steps of judging if the entrapment is generated within a predetermined range in which the power slide door can be stopped by portion of the stopper in a condition where the entrapment with a foreign object is generated during an opening operation of the power slide door, performing a reverse operation of the power slide door in a closing direction by a certain distance in a condition where the entrapment is generated within the predetermined range, and stopping the power slide door.

16 Claims, 5 Drawing Sheets

U.S. PATENT DOCUMENTS

2005/0179409 A1* 8/2005 Honma et al. ..... 318/62
2005/0179415 A1* 8/2005 Nakano et al. ..... 318/478
2006/0202507 A1* 9/2006 Miyagawa et al. ..... 296/155
2006/0283089 A1* 12/2006 Ishihara et al. ..... 49/360
2007/0138832 A1* 6/2007 Kraus et al. ..... 296/155

* cited by examiner

METHOD FOR CONTROLLING DOOR AND DOOR CONTROL SYSTEM FOR VEHICLE

This application is based on and claims priority under 35 U.S.C. §119 to Japanese Patent Application 2005-330639, filed on Nov. 15, 2005, the entire content of which is incorporated herein by reference.

FIELD OF THE INVENTION

The present invention relates to a method for controlling a door for a vehicle and a door control system for a vehicle. More particularly, the present invention relates to a technology for efficiently avoiding an interference (e.g., an entrapment) that may occur when the door for the vehicle is operated.

BACKGROUND

Conventionally, there are vehicles which include an electric slide door (described as a power slide door or PSD in a specification of the present invention) having an operable window as a vehicle door such as a side door of an automobile. With reference to FIG. 5, the power slide door allows a user to enter and exit the vehicle by sliding the door even in a condition where the window (e.g., side window) is opened. A request has been placed for ensuring safety by avoiding an entrapment between a frame of the door (e.g., slide door sash) and a vehicle body (e.g., rear quarter pillar) for conditions where a hand or a head of a child is put out of the opened window.

Conventionally, there are following techniques for ensuring the safety. According to JP2000240352A, an opened/closed state of the side window is detected by an ECU (i.e., Electric Control Unit) and the power slide door is stopped before a fully opened state in a condition where the side window is opened so that a space, more than or equal to a certain width, between the frame of the door and the vehicle body can be ensured. However, in this case, a device (e.g., a sensor, a switch) for detecting the opened/closed state of the side window is required.

In contrast, a technique is proposed for reducing a manufacturing cost by omitting a sensor, or the like, while ensuring safe operational use. For example, a control system is provided with a mechanical stopper, serving as a support shaft in a condition where the side window is opened, for performing an intermediate stop operation in conjunction with the side window of the slide door. More specifically, in a condition where the side window is opened, a mechanical stopper is automatically protruded from the power slide door and a movable range of the power slide door is limited by stopping a movement of the power slide door before reaching the fully opened state. On this occasion, a mechanical stopper interference range is preliminarily calculated by a moving amount of the power slide door. The calculated range is set in the ECU and the power slide door is stopped at a position in which the entrapment is detected when the entrapment occurs within the range.

When the sensor, or the like, is omitted, the manufacturing cost can be reduced. However, in a condition where a human or a foreign object is trapped within the predetermined range, the power slide door may be stopped and fixed at the position in which the entrapment occurs.

A need thus exists to provide a method for controlling a door and a door control system for a vehicle provided with a higher degree of safety while reducing a manufacturing cost.

SUMMARY OF THE INVENTION

According to an aspect of the present invention, a method for controlling a power slide door having an operable window for a vehicle for preventing an entrapment between the power slide door and a vehicle body by limiting a slidable range of the power slide door by means of a stopper, which the stopper functions in a condition where the window is opened more than or equal to a certain range, the method comprising steps of judging if the entrapment is generated within a predetermined range in which the power slide door can be stopped by means of the stopper in a condition where the entrapment with a foreign object is generated during an opening operation of the power slide door, performing a reverse operation of the power slide door in a closing direction by a certain distance in a condition where the entrapment is generated within the predetermined range, and stopping the power slide door.

According to another aspect of the present invention, a door control system for a vehicle, comprising a power slide door having an operable window, a drive motor performing an opening/closing operation of the power slide door, a transmission mechanism transmitting a driving force of the drive motor to the power slide door, a connect/disconnect device for connecting/disconnecting the power slide door relative to the transmission mechanism, a stopper limiting a slidable range of the power slide door when the window is opened more than or equal to a predetermined range and preventing an entrapment between the power slide door and a vehicle body, and a control device judging if the power slide door is positioned within a predetermined range including a position in which the power slide door can be stopped by means of the stopper in a condition where the entrapment with a foreign object is generated during the opening operation of the power slide door, the control device stopping the power slide door after performing a reverse operation in a closing direction by a certain distance when the power slide door is positioned within the predetermined range.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
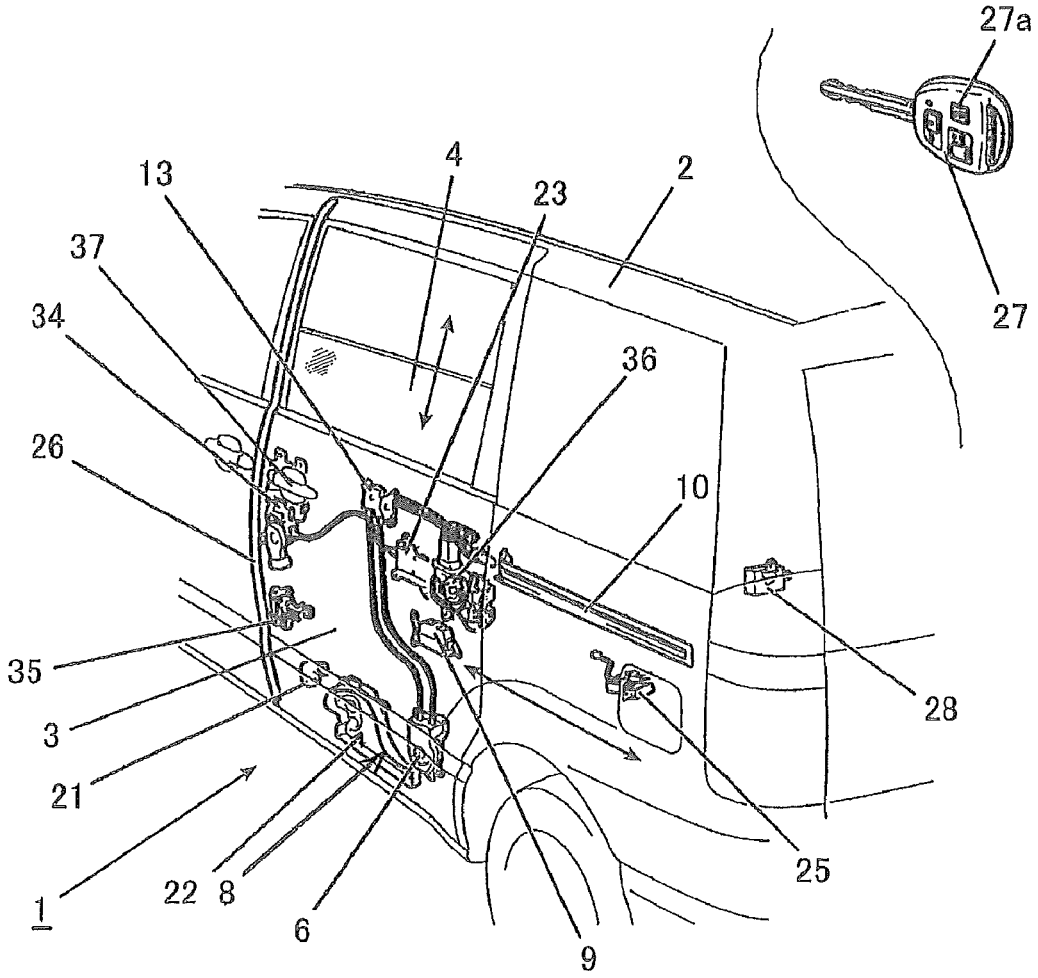
FIG. 1 is a schematic view illustrating a door control system for a vehicle according to an embodiment of the present invention and showing the door control system for the vehicle provided at a side portion of the vehicle with the side portion of the vehicle.

An embodiment of the present invention will be explained hereinafter with reference to illustrations of drawing figures as follows.

An embodiment of the present invention will be explained hereinafter with reference to FIGS. 1-5. Regarding an operation of a power slide door 3 having a side window 4, a door control system 1 prevents an entrapment between the power slide door 3 and a vehicle body 2 (also described as a vehicle in this specification) by limiting a slidable range of the power slide door 3 by means of a stopper, which is operated in a condition where the side window 4 is opened more than or equal to a predetermined range. According to the embodiment of the present invention, when an interference such as the entrapment occurs in a range in which the power slide door 3 is stopped by means of a mechanical stopper, which is operated when the side window 4 is opened, the power slide door 3 reverses in a closing direction for a certain distance, stops, and holds that position. With such a control, the door control system 1 can realize a higher degree of safety.

In principle when the side window 4, provided at the power slide door 3, does not open (the side window is not an operable power window), entrapment does not occur. Thus, in this case, an advantage of using the door control system 1 is limited. Further, even when the side window 4 is, for example, an operable power window and is open, if a sufficient space between a frame of the power slide door 3 (e.g., a slide door sash) and a vehicle body 2 (e.g., a rear quarter pillar) is ensured, the entrapment is not generated in principle. Therefore, also in such case, the advantage of using the door control system 1 is limited. According to the embodiment, the present invention is applied to the vehicle 2 having the operable side window 4. Further, the space between the frame of the power slide door 3 and the vehicle body 2 is not sufficient when the door is fully opened. First, the configuration of the door control system 1 will be explained. Then, a control of the system will be explained with reference to a flow chart.

The vehicle 2 and the door of the present invention are not limited. For example, the vehicle 2 can be a minivan and the power slide door 3 can be a slide type side door having a power assist mechanism. As illustrated in FIG. 1, the door control system 1 according to the embodiment of the present invention includes a drive motor 6, a transmission mechanism 7, a connect/disconnect device 8, the mechanical stopper, and a control device 9.

Figure 5:
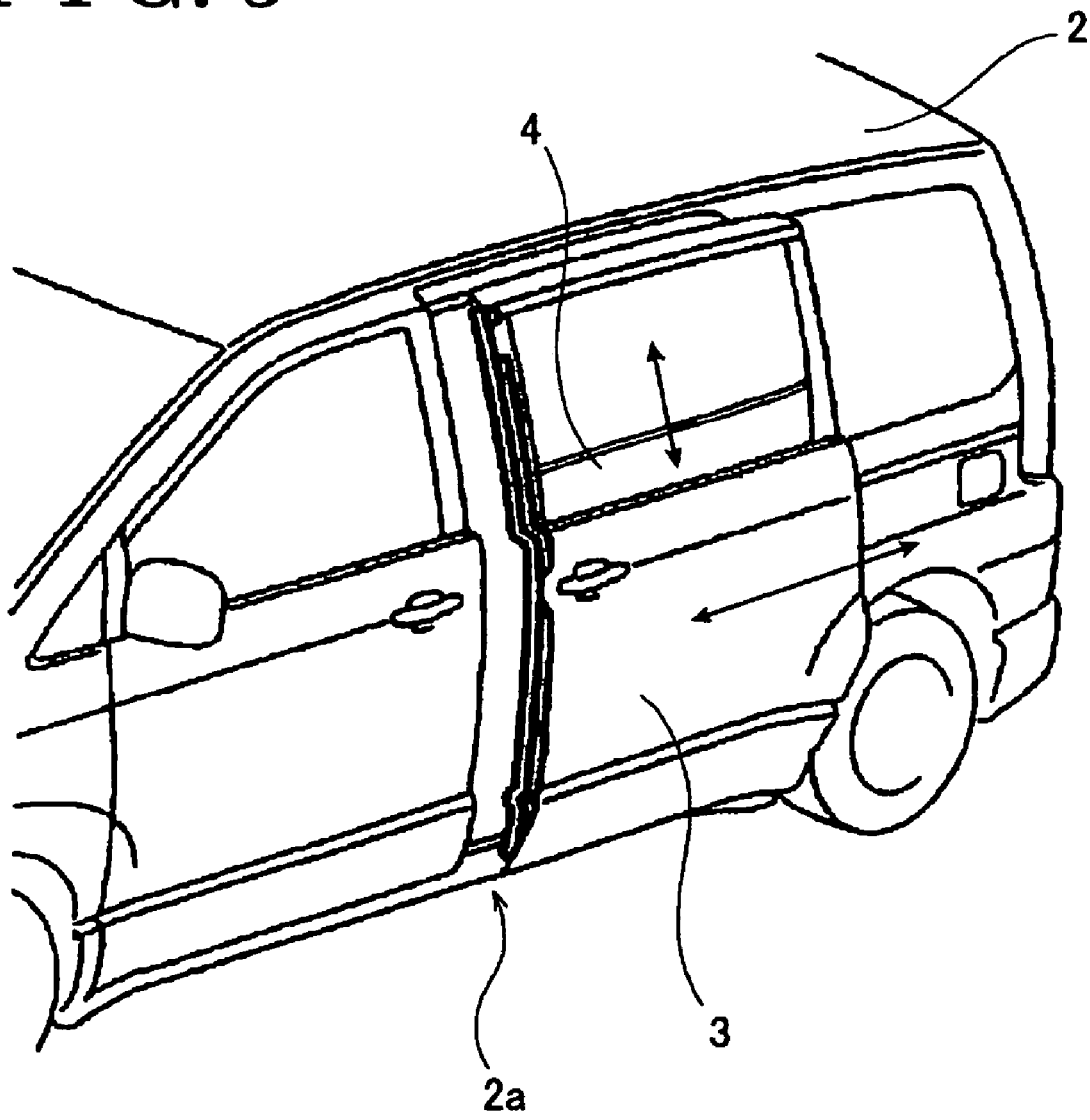
FIG. 5 is a view illustrating a power slide door, sliding in a condition where the side window is opened more than or equal to a certain width, and surroundings of the power slide door.

The power slide door 3 having an operable window (the side window 4 in the embodiment of the present invention) is slidable along a slide door rail 10 provided at a side portion of the vehicle 2. According to the embodiment of the present invention, the side window 4 can electrically be opened and closed by means of a lifting and lowering mechanism such as a motor. The power slide door 3 can be slid for performing opening and closing operations even in a condition where the side window 4 is half opened or fully opened, as illustrated in FIG. 5. By sliding the power slide door 3, a user can enter and exit the vehicle 2 through a platform 2*a*. The power slide door 3 can be operated by means of a power door switch 18, a button 27*a* of a transmitter 27, or a slide door handle 37, which is provided both at an outside and an inside of the power slide door 3.

The motor 6 is a driving source for performing the opening and closing operations of the power slide door 3. The motor 6 and the transmission mechanism 7 function as a power assist mechanism, which automatically operates the power slide door 3 or helps a manual operation of the power slide door 3. According to the embodiment of the present invention, the motor 6 is built in a lower part of the power slide door 3, as illustrated in FIG. 1. Further, the motor 6 includes a magnet clutch (not shown), which rotates with a motor shaft (not shown), and a hole IC, which detects a position of the magnet clutch as a pulse signal.

Figure 2:
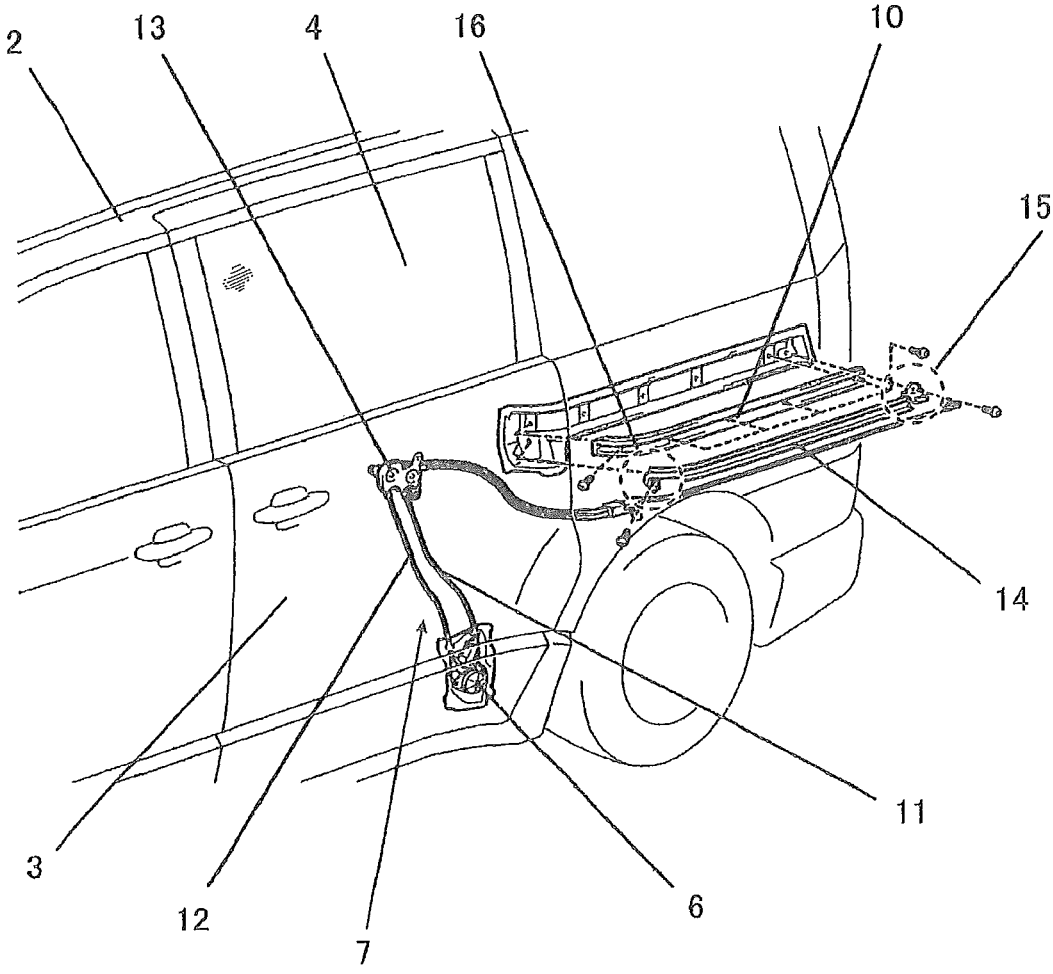
FIG. 2 is a view of the door control system for the vehicle illustrated in FIG. 1 viewed from other angle.

The transmission mechanism 7 transmits the driving force of the drive motor 6 to the power slide door 3. According to the embodiment of the present invention, the transmission mechanism 7 includes a cable 11 for opening the door, a cable 12 for closing the door, an intermediate pulley 13 to which the cables 11 and 12 are hooked, and a cable guide plate 14 extending along the slide door rail 10, as illustrated in FIG. 2. The cable 11 is pulled when the opening operation of the door is performed and the cable 12 is pulled when the closing operation of the door is performed. The cable guide plate 14 includes tensioner mechanisms 15 and 16. The tensioner mechanism 15 adjusts the tension of the cable 11 and the tensioner mechanism 16 adjusts the tension of the cable 12.

The connect/disconnect device 8 connects the power slide door 3 to the transmission mechanism 7 and disconnects the power slide door 3 from the transmission mechanism 7. According to the embodiment of the present invention, an electromagnetic clutch is used for the connect/disconnect device 8. When the electromagnetic clutch is applied with current, the power slide door 3 is connected to the transmission mechanism 7. In a condition where a connection between the power slide door 3 and the transmission mechanism 7 is released by the connect/disconnect device 8, i.e., in a condition where the electromagnetic clutch is disengaged, the power slide door 3 can manually be operated regardless of operating states of the transmission mechanism 7 and the drive motor 6.

The mechanical stopper limits the slidable range of the power slide door 3 in a condition where the side window 4 is opened more than or equal to the predetermined range for preventing entrapment between the power slide door 3 and the vehicle body 2. According to the embodiment of the present invention, the mechanical stopper is provided on the power slide door 3 to protrude so as to abut against the vehicle body 2 to prevent entrapment between the power slide door 3 and the vehicle body 2. However, the present invention is not limited thereto. Alternatively, or in addition, the mechanical stopper may be provided on the vehicle body 2 to protrude so as to abut against the power slide door 3 to prevent entrapment between the power slide door 3 and the vehicle body 2. With the configuration of the power slide door 3 and the stopper for preventing entrapment, there are basically three door stop positions, including a door fully opened position, a door fully closed position, and a position in which the door is stopped because of the stopper. According to the embodiment of the present invention, a mechanical device mechanically operated in conjunction with an operation of the side window 4 is used for the stopper. However, the present invention is not limited thereto, and variations and changes can be made by others.

In a condition where the entrapment between the power slide door 3 and a foreign object occurs during the opening operation of the door, the control device 9 judges whether a position, in which the entrapment occurs, is within a predetermined range having a position, in which the power slide door 3 can be stopped because of the mechanical stopper. In other words, when the operation of the power slide door 3 is interfered or stopped because of the entrapment between the power slide door 3 and the foreign object, the control device 9 judges the position of the power slide door 3 at that time. In consequence, when the control device 9 judges that the power slide door 3 is positioned within the predetermined range, the power slide door 3 reverses in the closing direction by the certain distance and stopped by activating the drive motor 6 and the transmission mechanism 7.

Figure 3:
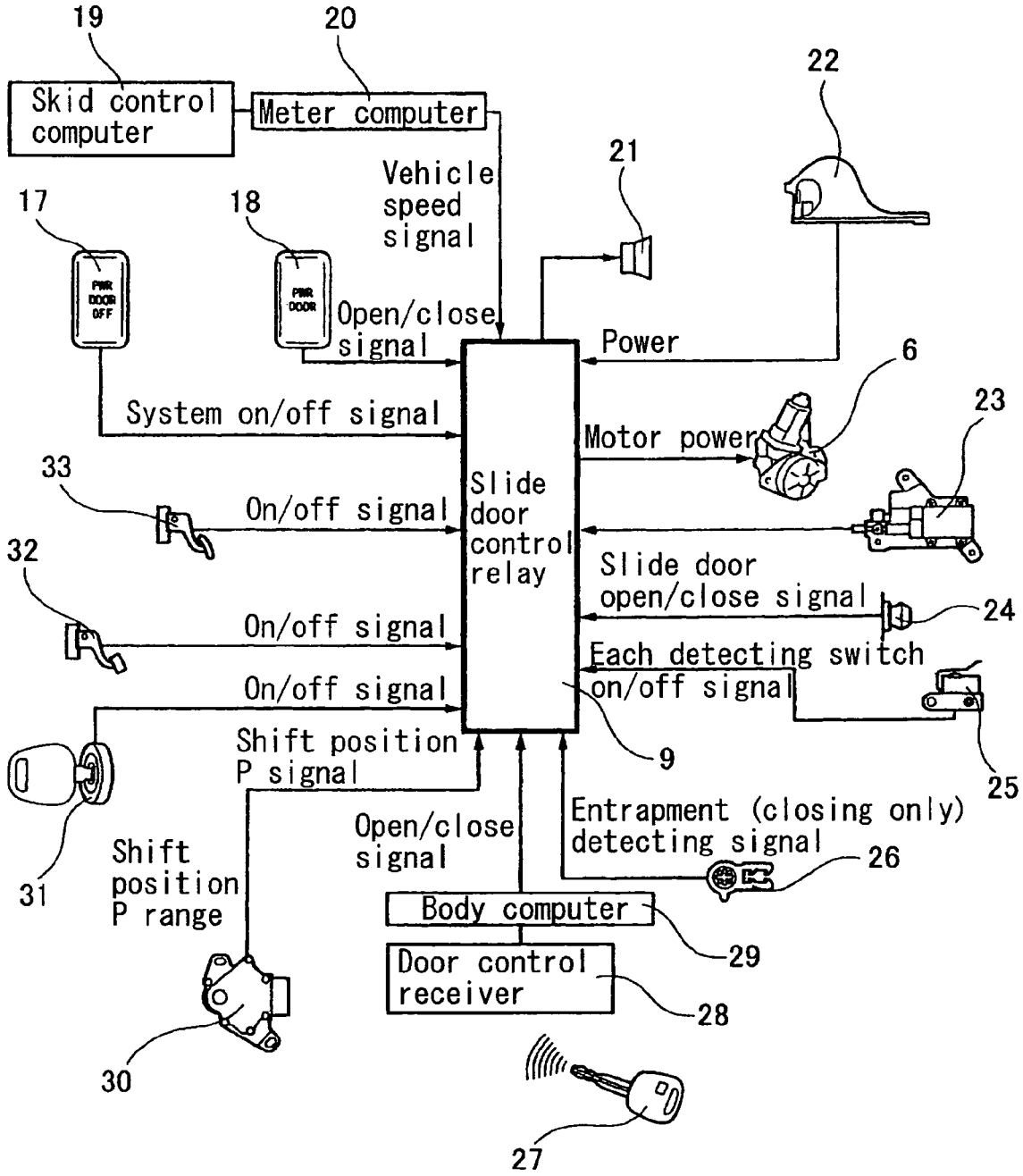
FIG. 3 is a block diagram illustrating a control device of the door control system for the vehicle and other devices.

According to the embodiment of the present invention, the control device 9 is configured of a slide door control relay for performing the above described control. However, the present invention is not limited thereto and the control device 9 may be configured of other mechanism. According to the embodiment of the present invention, the slide door control relay 9 is built in the power slide door 3, as illustrated in FIG. 1, and the slide door control relay 9 receives signals from various devices and transmits a signal, as illustrated in FIG. 3. The configuration of the control device 9 will schematically be explained as follows.

With reference to FIG. 3, a main switch 17 provided at a driver seat of the vehicle 2 transmits a system on/off signal relative to the slide door control relay 9. A power door switch 18 provided at the driver seat of the vehicle 2 transmits an open/close signal relative to the slide door control relay 9. A skid control computer 19 and a meter computer 20, which are connected in series, transmit a vehicle speed signal relative to the slide door control relay 9. An alarm buzzer 21 alarms at a predetermined timing for warning the user. A feeding electricity unit 22 for the slide door applies current to the slide door control relay 9. Because of the feeding electricity unit 22, a junction, a feeding electricity relay, or the like, is not required. Therefore, a system can be simplified and the number of components can be reduced. The slide door control relay 9, applied with current, supplies electric power to the drive motor 6.

During the operation of the power slide door 3 at a fully opened state or a fully closed state, a slide door lock release motor 23 rotates and pulls the cable 11 for opening or pulls the door or the cable 12 for closing the door. With reference to FIGS. 1 and 3, the slide door lock release motor 23 releases a slide door front lock device 35 and a slide door lock device 36 during the opening operation. In contrast, the slide door lock release motor 23 releases a fully open stopper (not shown) during the closing operation. The slide door lock device 36 functions as an easy closer, which brings the power slide door 3 into the fully opened stated by the electric power.

A slide door courtesy lamp switch 24 transmits a slide door open/close signal to the slide door control relay 9. A half open stopper control device 25 transmits a door unlock signal and a fuel lid open detecting signal to the slide door control relay 9. Further, a touch sensor 26 provided at an edge portion at a closing side of the power slide door 3 transmits an entrapment detecting signal to the slide door control relay 9 only when the closing operation is performed.

With reference to FIG. 1, a transmitter 27 is built in an ignition key for performing a wireless remote control function of the power slide door 3. With reference to FIGS. 1 and 3, an open/close signal from the transmitter 27 is transmitted to the slide door control relay 9 via a door control receiver 28 and a body computer 29. Further, a shift position P signal from a neutral start switch 30, an on/off signal from the ignition switch, an on/off signal from a parking brake 32 (i.e., a parking brake switch), and an on/off signal from a foot brake 33 (i.e., stop lamp switch), are respectively transmitted to the slide door control relay 9.

The door control system 1 is provided with a position sensor for detecting a position of the power slide door 3. According to the embodiment of the present invention, the hole IC outputs one circle pulse per rotation of a motor shaft. Further, the slide door control relay 9 detects the position of the power slide door 3 by counting the one circle pulse.

Figure 4:
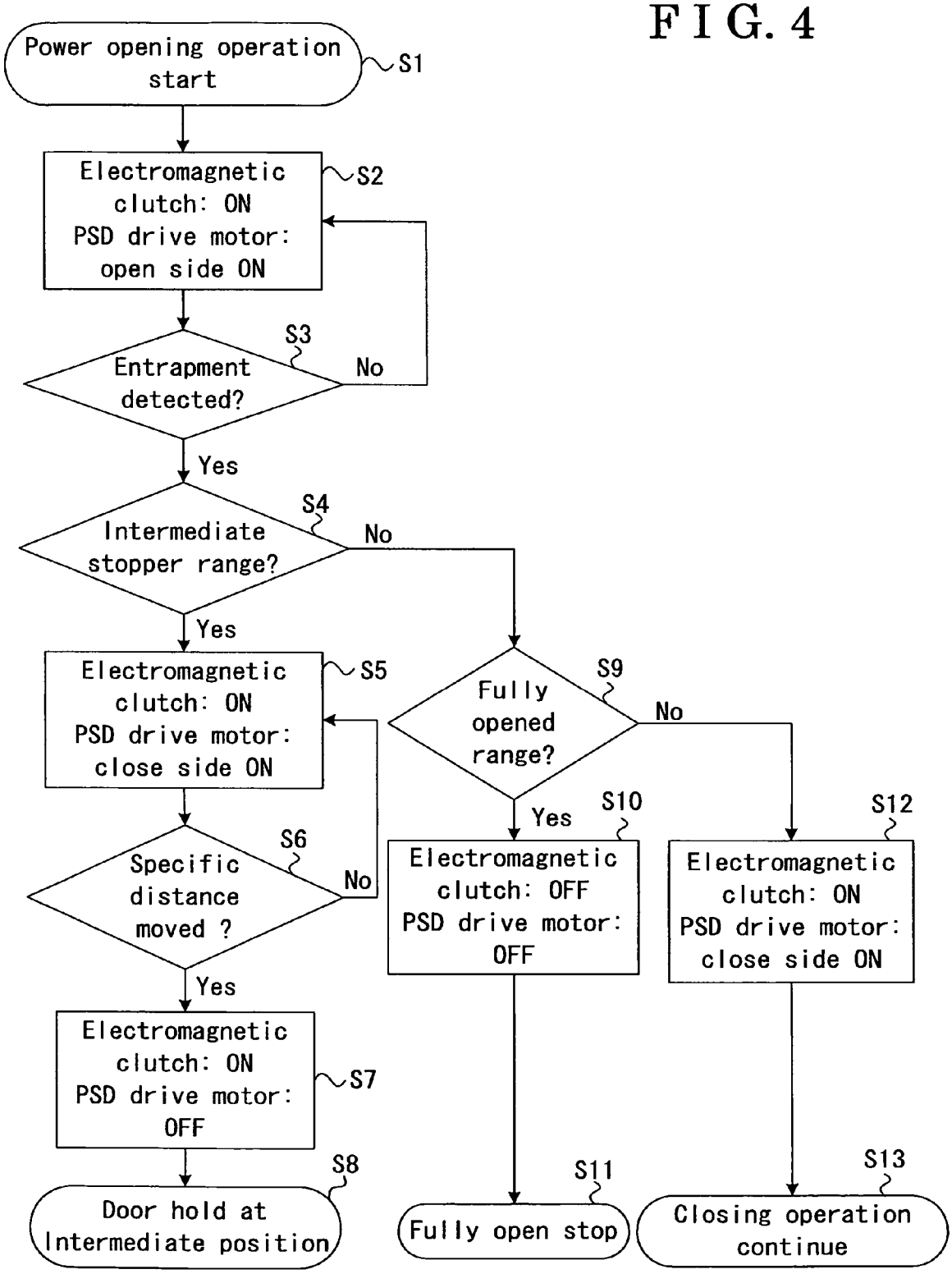
FIG. 4 is a flow chart illustrating a method for controlling the door for the vehicle according to the embodiment of the present invention.

With reference to the flow chart shown in FIG. 4, a control of the power slide door 3 will be explained hereinafter. According to the embodiment of the present invention, in a condition where the interference such as the entrapment occurs within the range, in which the power slide door 3 is stopped because of the mechanical stopper when the side window 4 is opened, the power slide door 3 is stopped after reversing in the closing direction by the certain distance and is held at that position. On this occasion, when the interference between the power slide door 3 and the foreign object occurs during the opening operation of the door, the control device 9 judges if the power slide door 3 is positioned within the predetermined range. The certain range includes the position in which the power slide door 3 can be stopped by means of the mechanical stopper. More specifically, depending on a vehicle type, the position, in which the mechanical stopper can function, and a width, in which the mechanical stopper can function, may differ. In view of the above mentioned considerations, some degree of margin (range/width) is set in the embodiment of the present invention and the some degree of margin is represented as a predetermined range (hereinafter also referred as an intermediate stopper range). According to the control method of the power slide door 3 in the embodiment of the present invention, the entrapment can be handled even in a condition where the mechanical stopper does not function, i.e., in a condition where the mechanical stopper does not protrude. In such condition, because the predetermined range includes a position in which the mechanical stopper would function, the predetermined range (i.e., the intermediate stopper range) is set as the range having the some degree of margin.

The control method of the power slide door 3 will be explained hereinafter. First, a series of action for opening the power slide door 3 from the fully closed state is started in step 1 (a power opening operation start). The power opening operation (i.e., the opening operation) is started by activating the power assist mechanism on the bases of a command outputted by means of the remote control of the power door switch 18 of the driver seat or the transmitter 27, an operation of the handle of the power slide door 3, i.e., an operation of the slide door handle 37, or the like. The door control system 1 received with the command turns on the electromagnetic clutch and turns on the drive motor 6 of the power slide door 3 (i.e., PSD) in step 2. The electromagnetic clutch at an ON state mechanically connects the power slide door 3 with the power assist mechanism (a mechanism for driving) and an operation of the power assist mechanism can thereby be transmitted to the power slide door 3. On this occasion, the drive motor 6 rotates in a direction in which the power slide door 3 is opens (step 2: opens side ON). Thereby, the power slide door 3 starts to slide in the opening direction (e.g. a direction toward a backward of the vehicle 2).

Next, a detection of the entrapment is performed in step 3. More specifically, a judgment is performed if a generation of the entrapment during the operation of the power slide door 3 is detected. The detection of the entrapment can be performed at the hole IC by detecting the rotational speed of the drive motor 6 as a parameter. The entrapment can be determined when the rotational speed of the drive motor 6 is slowed down. On this occasion, the entrapment includes a state in which the power slide door 3 slides and stops at the fully opened position. More specifically, the operation of the power slide door 3 is restricted and stopped by butting at a butting portion when the power slide door 3 is moved to the fully opened position. In step 3, even when the power slide door 3 stops at the fully opened position, the condition is judged as the entrapment. Reason for the entrapment, i.e., if the entrapment is detected because the power slide door 3 moves to the fully opened position or if the entrapment is detected because the entrapment is generated in actual, is judged after step 4. Until the entrapment is detected in step 3, the electromagnetic clutch and the drive motor 6 remain at ON state (step 3: No, step 2).

When the entrapment is detected in step 3 (step 3: Yes), it is judged if the power slide door 3 is positioned within the intermediate stopper range for confirming the existing position of the power slide door 3 in step 4. When the power slide door 3 is positioned within the intermediate stopper range, it is judged that the power slide door 3 is located at the position in which the power slide door 3 can be stopped by means of the mechanical stopper (including a condition where the power slide door 3 is stopped by actually butting against the mechanical stopper) and the procedure progresses to step 5 (step 4: Yes). In contrast, when the power slide door 3 is not positioned within the intermediate stopper range, the procedure progresses to step 9 for judging whether the power slide door 3 is stopped at the fully opened position or the power slide door 3 is stopped because the entrapment occurs in actual (step 4: No).

When it is judged that the position of the power slide door 3 is within the intermediate stopper range (step 4: Yes), the drive motor 6 is driven in the closing direction of the power slide door 3 while maintaining the electromagnetic clutch at the ON state in step 5. More specifically, the drive motor 6 is driven reverse to move the power slide door 3 in the closing direction. A reverse movement (the movement in the closing direction) is performed until the power slide door 3 is moved by a specified distance in step 6. A sliding speed of the power slide door 3 during a reverse operation may be slower than a sliding speed during the opening operation before the reverse operation is performed. When the sliding speed itself is slowed down, a smooth operation can be realized without influencing an operation such as an avoidance of the entrapment, a removal of a load when the entrapment occurs, or the like.

The specified distance (a certain distance) in step 6 is not particularly limited. As long as the load, especially applied to the user, can sufficiently be removed when the entrapment occurs, the specified distance may take various values depending on a size of the power slide door 3 or a setting position of the mechanical stopper. Further, the present invention is applicable as long as a space (an opening width) is ensured for smoothly getting on and getting out between the vehicle body 2 and the power slide door 3. For example, when the specified distance (a return value) is set within a range from 10 mm to 30 mm, the space for getting on and getting out can readily be ensured in a condition where the load is sufficiently removed.

When the power slide door 3 is moved in the closing direction by the specified distance (step 6: Yes), the drive motor 6 is turned off in a condition where the ON state of the electromagnetic clutch is maintained and the power slide door 3 is stopped at that position in step 7. More specifically, the power slide door 3 reverses by the certain distance, stops, and remains at that position. As described above, the power slide door 3 performs a reverse closing operation, i.e., the power side door 3 returns in the closing direction by the specific distance from the position in which the entrapment occurs and temporally stops at that position. According to the embodiment of the present invention, because the electromagnetic clutch is remained at the ON state, a lock state is maintained and the power slide door 3 cannot freely be slid. If the lock state is released in a condition where the vehicle 2 slants at a slope, the power slide door 3 may be moved due to gravity force and the entrapment may repeatedly occur. In view of the above mentioned considerations, according to the embodiment of the present invention, the lock state of the power slide door 3 is maintained even after the reverse closing operation is performed and the drive motor 6 is turned off in step 7.

When the reverse closing operation is performed after the generation of the entrapment within the intermediated stopper range in step 7, the power slide door 3 is held at an intermediate position in step 8. The intermediate position is placed between the fully opened position and the fully closed position of the power slide door 3. In other words, the intermediate position is a position in which the power slide door 3 is moved reverse by the specific distance.

There are various operations for re-operating the power slide door 3 at a holding state. According to the embodiment of the present invention, the drive motor 6 is turned on and the power slide door 3 is automatically closes when the slide door handle 37 of the power slide door 3 is pulled, the power door switch 18 of the drive seat is operated, or a remote control button of the wireless transmitter 27 is operated. However, the present invention is not limited thereto. Alternatively, or in addition, the lock state of the power slide door 3 may be released by turning off the electromagnetic clutch after a predetermined time (e.g., after 30 minutes) has passed. On this occasion, a few seconds or several tens of seconds before an automatic release of the lock state, an alarm may be given by the alarm buzzer 21 for giving an advance notice of the user.

After the detection of the entrapment, when the power slide door 3 is not positioned within the intermediate stopper range (step 4: No), it is judged if the power slide door 3 is stopped at the fully opened position or the power slide door 3 is stopped because the entrapment actually occurs, in step 9. When the power slide door 3 is stopped because the power slide door 3 reaches the fully opened position (step 9: Yes), the electromagnetic clutch is turned off and the drive motor 6 is turned off in step 10. Then, the power slide door 3 comes into a fully opened and stopped state and the power opening operation (opening operation) is terminated in step 11. On this occasion, the fully opened and stopped state is a state in which the power slide door 3 reaches the fully opened position without generating the actual entrapment during the power opening operation. In this case, because the power slide door 3 can be held by a fully opened state holding mechanism (not shown) provided at the vehicle 2, the electromagnetic clutch and the drive motor 6 are turned off in step 12. The fully opened state holding mechanism mentioned above is not particularly different from a well known mechanism and is a mechanical mechanism for holding the power slide door 3 in the fully opened state at the fully opened position.

In contrast, when the power slide door 3 is not positioned within a fully opened range (step 9: No), the procedure progresses as follows. In this case, because the entrapment detected in step 3 is not positioned within the intermediate stopper range (step 4: No) and the fully opened range (step 9: No), it is judged that the entrapment is actually happened, for example, a hand is trapped between the vehicle 2 and the power slide door 3, and the drive motor 6 is turned on in the closing direction in a condition where the ON state of the electromagnetic clutch is maintained in step 12. Then, the power slide door 3 is reversed from a position in which the entrapment occurs and the entrapment is promptly released. According to the embodiment of the present invention, the closing operation continues in step S13 and a series of the power opening operation temporarily terminates when the power slide door 3 is closed. The detection of the entrapment is also performed during the power closing operation although it is not explained in detail in the specification. When the entrapment is detected until the power slide door 3 is closed, the power slide door 3 is stopped at the position in which the entrapment is detected.

As explained above, with the configuration of the door control system 1 according to the embodiment of the present invention, a higher degree of safety can be provided.

According to the control disclosed in the embodiment of the present invention, even when the power slide door 3 is in contact with an obstacle (e.g., human, object) in a condition where the opening operation of the power slide door 3 is performed while the side window 4 is closed, the entrapment is detected in step 3 and the reverse closing operation is performed over the specific distance and the power slide door 3 is stopped at that position. Further, when the power slide door 3 is in contact with the obstacle, the power slide door 3 is prevented from keep pushing the obstacle. Therefore, a further influence on an exterior obstacle (e.g., human, object) can be avoided as much as possible. Moreover, the power slide door 3 itself can be prevented from being damaged or deformed.

According to the embodiment of the present invention, because a control method is constructed for preventing the entrapment regardless of an opened/closed state of the side window 4 of the power slide door 3, a switch, a sensor, or the like, which is provided only for detecting the opened/closed state of the side window 4, is not required. In case the switch, the sensor, or the like, is provided, a sensitive control of the power slide door 3 can be performed. However, because there are few opportunities to use such switch or the like, providing the switch or the like may be inconvenient from a financial point of view. According to the embodiment of the present invention, because a safe and an economical operation can be realized by performing a characteristic control without providing the switch or the like, it is very effective in cost performance. Accordingly, a method for effectively ensuring safety and as well as reducing manufacturing cost can be realized.

The embodiment of the present invention has been described in the foregoing specification. However, the invention which is intended to be protected is not to be constructed as limited to the particular embodiment disclosed. Variations and changes may be made by others. For example, an expression of entrapment is mainly used in the specification. However, entrapment is used for easy understanding and entrapment is used as an example to explain the interference between the power slide door 3 and the foreign object. For example, in a condition where the human is trapped between the power slide door 3 and the other obstacle (e.g., a wall surrounding the vehicle body 2), if the power slide door 3 is stopped in a condition where the power slide door 3 is in contact with the human, the human cannot be moved and cannot escape from a trapped position. However, according to the embodiment of the present invention, the power slide door 3 is stopped after reversing by the specified distance. Therefore, the power slide door 3 can be prevented from being stopped in a condition where the power slide door 3 is in contact with the human. In consequence, according to the control method of the present invention, the door control system 1 can handle various interferences caused by events besides the actual entrapment. Further, a contact with the exterior portion as described above is also a part of the interference and is detected as the entrapment according to the embodiment of the present invention.

According to the embodiment of the present invention, in a condition where the interference between the power slide door and the foreign object occurs and the power slide door is stopped, the judgment is performed if a position in which the interference occurs is within the predetermined range. The predetermined range includes the position in which the power slide door can be stopped by means of the mechanical stopper. In other words, the predetermined range is a range in which the slidable range of the power slide door is limited for preventing a part of the user's body from trapping between the frame of the door and the vehicle body (vehicle). When it is judged that the interference occurs within the predetermined range, the power slide door reverses in the closing direction. According to a conventional art, the power slide door is stopped at the position in which the interference occurs. In contrast, according to the embodiment of the present invention, the power slide door reverses in the closing direction by the predetermined distance and the higher degree of safety can be ensured.

When the power slide door is not positioned within the predetermined range in a condition where the interference with the foreign object occurs, the interference is handled as follows. When the interference occurs because the power slide door is reached to the fully opened position, it can be judged that the opening operation is terminated without any problem because the entrapment, or the like, is not actually occurring. In contrast, when the entrapment occurs in a condition where the power slide door does not reach the fully opened position or is not within the predetermined range, it is judged that the entrapment actually occurs within a range besides the predetermined range and the power slide door reverses in the closing direction.

The above described certain distance may be set as a distance in which the load applied to the foreign object can sufficiently be removed and the space at the side of the power slide door which is stopped after the reverse operation can be ensured so that the user can enter and exit the vehicle.

According to the embodiment of the present invention, because the power slide door reverses in the closing direction by the certain distance so that the load can be removed, the load applied to the user can promptly be eased or removed even in a condition where a part of the body is trapped between the vehicle and the power slide door. Further, because the moving amount of the power slide door is limited for ensuring the space through which the user can enter and exit the vehicle while removing the load, the user can enter and exit the vehicle through the platform in a condition where the control is terminated for a while. Therefore, the trouble of manually operating the door or operating a switch of the door can be avoided.

After the power slide door is operated reverse in the closing direction by the certain distance and is stopped, the power slide door may be held at the stopped position in a condition where the power slide door cannot be slid. Accordingly, the power slide door can be prevented from unwillingly sliding due to the gravity force even when the vehicle is positioned at the slope and is slanted.

The sliding speed of the power slide door during the reverse operation in the closing direction by the certain distance may be slower than the sliding speed of the power slide door in the opening direction before the reverse operation is performed. When the sliding speed itself is slowed down, the smooth operation can be realized without influencing the operation such as the avoidance of the entrapment, the removal of the load when the entrapment occurs, or the like. Further, a burden on the drive motor, on the transmission mechanism, or the like, can be reduced.

According to the embodiment of the present invention, the control of the door is performed regardless of the opened/closed state of the window. For example, when the power slide door is opened in a condition where the window is closed, there is no possibility of generating the entrapment between the frame of the door (e.g., the slide door sash) and the vehicle body (e.g., rear quarter pillar). On this occasion, the stopper does not function to limit the slidable range of the door. However, according to the control of the present invention, the control system does not judge if the stopper actually functions, but rather judges if the power slide door is positioned within the predetermined range including the position in which the power slide door can be stopped. Therefore, the control of the door can be performed regardless of the operation of the stopper. According to the control of the present invention, the switch, the sensor, or the like provided only for detecting the opened/closed state of the window is not required.

According to the control system of the door of the present invention, when the power slide door is stopped because of the entrapment between the foreign object during the opening operation, the control device judges if the position in which the entrapment occurs is within the predetermined range. As described above, the predetermined range includes the position in which the power slide door can be stopped because of the mechanical stopper. In other words, the predetermined range is the range in which the slidable range of the power slide door is limited for preventing the part of the user's body from entrapping between the frame of the door and the vehicle body. When it is judged that the interference occurs within the predetermined range, the power slide door reverses in the closing direction. Because of the reverse operation of the power slide door, the higher degree of safety can be provided according to the present invention.

With the configuration of the door control system 1 according to the present invention, the higher degree of safety between the power slide door and the vehicle body can be ensured. Further, because the control method is constructed for avoiding the entrapment (i.e., interference) regardless of the opened/closed state of the window of the power slide door, the switch, or the like, which is provided only for detecting the opened/closed state of the window is not required. Therefore, the manufacturing cost can be reduced while efficiently ensuring the safety.

The principles, preferred embodiment and mode of operation of the present invention have been described in the foregoing specification. However, the invention which is intended to be protected is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A method for controlling a power slide door of a vehicle to prevent entrapment between the power slide door and a vehicle body by limiting a slidable range of the power slide door, wherein the slide door comprises an operable window and is operable by a user-operated mechanism, the method comprising:

moving the power slide door in an opening direction toward a fully open position, the movement of the slide door in the opening direction being stoppable at an intermediate stop position by a stopper as a result of the window being at least partially open, the stopper being a mechanism of the vehicle;

judging if entrapment of the moving slide door with a foreign object occurs within a predetermined range, the predetermined range extending from a starting position to a finishing position and including the intermediate stop position between the starting position and the finishing position, the starting position of the predetermined range being different from the fully open position and a fully closed position of the slide door, and the finishing position of the predetermined range being different from the fully open position and the fully closed position of the slide door;

moving the slide door a specified distance in a closing direction, which is a direction that is reverse of the opening direction, to a stopped position, the specified distance being less than the distance required to move the slide door to the fully closed position, when it is judged that entrapment of the moving slide door in the predetermined range has occurred; and stopping and holding the slide door at the stopped position in a condition in which, if a predetermined time has not passed, the slide door cannot be moved except when the user-operated mechanism is operated during the predetermined time period.

2. The method for controlling the door for the vehicle according to claim 1, further comprising judging if entrapment of the moving slide door with a foreign object occurs outside the predetermined range and outside a fully opened range, moving the slide door in the closing direction until the slide door reaches the fully closed position when it is judged that entrapment of the moving sliding door outside the predetermined range and outside the fully opened range has occurred.

3. The method for controlling the door for the vehicle according to claim 2, wherein a moving speed of the slide door during movement of the slide door in the closing direction, when entrapment of the moving sliding door in the predetermined range has occurred, is slower than a moving speed of the slide door in the opening direction toward the fully open position.

4. The method for controlling the door for the vehicle according to claim 2, wherein the slide door is moved in the closing direction when entrapment of the moving sliding door in the predetermined range has occurred regardless of an opened or closed state of the window.

5. The method for controlling the door for the vehicle according to claim 1, wherein the specified distance is a distance in which at least a load applied to the foreign object is removed and a space exists at a side of the slide door allowing a user to enter and exit the vehicle.

6. The method for controlling the door for the vehicle according to claim 5, wherein the slide door is moved by a motor and a transmission mechanism connected to the slide door by way of a clutch, and wherein after the slide door moves the specified distance in the closing direction, the slide door is held at the stopped position while the clutch is engaged so that the slide door cannot be slid.

7. The method for controlling the door for the vehicle according to claim 6, wherein a moving speed of the slide door during movement of the slide door in the closing direction, when entrapment of the moving sliding door in the predetermined range has occurred, is slower than the moving speed of the slide door in the opening direction toward the fully open position.

8. The method for controlling the door for the vehicle according to claim 6, wherein the slide door is moved in the closing direction when entrapment of the moving sliding door in the predetermined range has occurred regardless of an opened or closed state of the window.

9. The method for controlling the door for the vehicle according to claim 5, wherein a moving speed of the slide door during movement of the slide door in the closing direction, when entrapment of the moving sliding door in the predetermined range has occurred, is slower than a moving speed of the slide door in the opening direction toward the fully open position.

10. The method for controlling the door for the vehicle according to claim 5, wherein the slide door is moved in the closing direction when entrapment of the moving sliding door in the predetermined range has occurred regardless of an opened or closed state of the window.

11. The method for controlling the door for the vehicle according to claim 1, wherein a moving speed of the slide door during movement of the slide door in the closing direction, when entrapment of the moving sliding door in the predetermined range has occurred, is slower than a moving speed of the slide door in the opening direction toward the fully open position.

12. The method for controlling the door for the vehicle according to claim 11, wherein the slide door is moved in the closing direction when entrapment of the moving sliding door in the predetermined range has occurred regardless of an opened or closed state of the window.

13. The method for controlling the door for the vehicle according to claim 1, wherein the slide door is moved in the closing direction when entrapment of the moving sliding door in the predetermined range has occurred regardless of an opened or closed state of the window.

14. A method for controlling a vehicle power slide door to prevent entrapment between the power slide door and a vehicle body, wherein an operable window is mounted in the door and the door is operable by a user-operated mechanism, the method comprising:

moving the power slide door in an opening direction away from a fully closed position and toward a fully open position, the movement of the slide door in the opening direction being stoppable at an intermediate stop position by a stopper as a result of the window being at least partially open;

determining if entrapment of the moving slide door with a foreign object occurs within a predetermined range, the predetermined range extending from a starting position of the predetermined range to a finishing position of the predetermined range, with the intermediate stop position located between the starting position of the predetermined range and the finishing position of the predetermined range, the starting position of the predetermined range being different from the fully open and fully closed positions of the slide door, and the finishing position of the predetermined range being different from the fully open and fully closed positions of the slide door;

moving the slide door a specified distance in a closing direction, which is a direction that is reverse of the opening direction, to a stopped position, the specified distance being less than the distance required to move the slide door to the fully closed position, when it is determined that entrapment of the moving slide door has occurred in the predetermined range; and stopping and holding the slide door at the stopped position, the stopped position being spaced from the fully closed position, in a condition in which, if a predetermined time has not passed, the slide door cannot be moved except when the user-operated mechanism is operated during the predetermined time period.

15. The method for controlling the door for the vehicle according to claim 14, wherein the slide door is moved in the closing direction when entrapment of the moving sliding door in the predetermined range has occurred independent of whether the window is opened or closed.

16. The method for controlling the door for the vehicle according to claim 14, wherein a moving speed of the slide door during movement of the slide door in the closing direction, when entrapment of the moving sliding door in the predetermined range has occurred, is slower than a moving speed of the slide door in the opening direction toward the fully open position.

* * * * *